United States Patent [19]

Costa, Jr. et al.

[11] 4,182,735

[45] Jan. 8, 1980

[54] PRODUCTION OF HIGH CRIMP, HIGH STRENGTH, HOLLOW RAYON FIBERS

[75] Inventors: Eugene Costa, Jr., Goshen; Madhu P. Godsay, Monroe, both of N.Y.

[73] Assignee: International Paper Company, New York, N.Y.

[21] Appl. No.: 908,982

[22] Filed: May 25, 1978

[51] Int. Cl.[2] ..... D01F 2/08

[52] U.S. Cl. ..... 264/54; 264/188; 264/209

[58] Field of Search ..... 264/188, 54, 209; 428/398

[56] References Cited

U.S. PATENT DOCUMENTS

| | | | |
|---|---|---|---|
| 1,915,952 | 6/1933 | Richter et al. | 264/184 |
| 2,013,491 | 9/1935 | Freund | 264/188 |
| 2,123,493 | 7/1938 | Alles | 264/188 |
| 2,597,624 | 5/1952 | Dresch et al. | 264/188 |
| 2,890,130 | 6/1959 | Howsman | 106/165 |
| 2,935,373 | 5/1960 | Spanning | 264/188 |
| 3,007,766 | 11/1961 | Blssner et al. | 264/188 |
| 3,046,079 | 7/1962 | Reeves et al. | 8/116.4 |
| 3,241,553 | 3/1966 | Steiger | 128/156 |
| 3,351,696 | 11/1967 | Dresch | 264/195 |
| 3,418,405 | 12/1968 | Kajitana | 264/190 |
| 3,622,261 | 11/1971 | Cotton et al. | 8/116.4 |
| 3,626,045 | 12/1971 | Woodings | 264/54 |
| 3,632,468 | 1/1972 | Daul et al. | 264/168 |
| 3,720,743 | 3/1973 | Stevens et al. | 264/168 |
| 3,793,136 | 2/1974 | Daul et al. | 264/168 |
| 3,907,499 | 9/1975 | Ingram et al. | 8/181 |

FOREIGN PATENT DOCUMENTS

| | | | |
|---|---|---|---|
| 898461 | 4/1972 | Canada . | |
| 1143666 | 4/1957 | France . | |
| 40-9536 | 5/1965 | Japan . | |
| 40-9537 | 5/1965 | Japan . | |
| 48-20164 | 6/1973 | Japan . | |
| 48-20165 | 6/1973 | Japan | 264/188 |
| 49-21247 | 5/1974 | Japan | 264/188 |
| 488500 | 7/1938 | United Kingdom . | |
| 945306 | 12/1963 | United Kingdom . | |
| 1393778 | 5/1975 | United Kingdom . | |
| 488500 | 7/1938 | United Kingdom . | |
| 1393778 | 5/1975 | United Kingdom . | |

OTHER PUBLICATIONS

"Second Generation HWM Rayon", Modern Textiles, pp. 19–23, Apr. 1976.

"Never Dried Cotton Fibirs", J. L. Williams et al., Research Jourl., 44, No. 5, pp. 370–377 (May 1974).

"The Mechanism of Swollen State Formaldehyde Cross-linking of Cellulose", F. R. Smith, *Tec. Res. J.*, pp. 301–306 (May 1972).

"Hollow Rayon Fibers–An Annotated Bibliography", *Lusk of Paper Chem.*, Appleton, Wisconsin (Oct. 7, 1974).

*Chem. Abst.*, vol. 80, p. 53, Abstract No. 60915p (1974).

*Chem. Abst.*, vol. 80, p. 65, Abstract No. 71967h (1974).

*Primary Examiner*—Jay H. Woo

[57] ABSTRACT

High crimp, high strength, hollow rayon fibers or filaments which maintain their hollowness after being immersed in water and subsequently dried, and have a crimped configuration such that there is in excess of about 20 crimps per inch, preferably between about 25–30 crimps per inch, are provided by an in-line process whereby a viscose solution containing a blowing agent is extruded into an aqueous acid coagulating bath. The conditions of the process result in hollow filaments that are substantially irreversible since they remain hollow and do not collapse even after repeated washing and drying cycles. The hollow filaments possess high crimp, such as about 25–30 crimps per inch, which will permit ease in carding and blending with other fibers. The high crimp hollow fibers also possess high strength nearly equivalent to that of high wet modulus rayon fibers.

10 Claims, 1 Drawing Figure

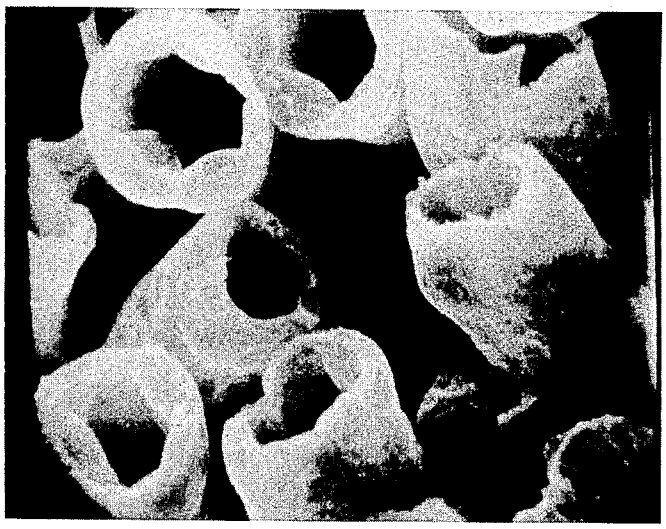

PRODUCTION OF HIGH CRIMP, HIGH STRENGTH, HOLLOW RAYON FIBERS

BACKGROUND OF THE INVENTION

The present invention relates to processes for the production of high crimp, high strength, hollow rayon fibers or filaments which will recover their hollow condition after being immersed in water and are substantially irreversible in that they will remain hollow and do not collapse even after repeated drying and washing cycles. These fibers will also possess high crimp of at least about 20 crimps per inch, preferably 25–30 crimps per inch, when immersed in water and dried in a tension-free state. The invention relates also to the high crimp hollow rayon fibers produced.

Hollow rayon fibers are known to the prior art. They have a number of known uses in the production of paper and non-woven products. They have been produced by incorporating a blowing agent, such as sodium carbonate or sodium bicarbonate, into the viscose rayon process. In the prior art processes, the viscose, containing the blowing agent, is spun into the conventional acidic spin bath whereby carbon dioxide gas is liberated from the blowing agent causing the fibers to blow or expand to several times their natural diameter.

A number of patents disclose processes of this type, and they have the shortcoming that when the fibers or filaments are dried, the fiber walls collapse, and, in most instances, hydrogen bond together to form a flat, ribbon-like fiber. Other processes that produce a substantially irreversible hollow fiber have the shortcoming of possessing inadequate crimp such that the fibers are difficult to blend with other fibers and have poor carding capability (fibers do not cling well enough to each other to form a sufficiently strong web for processing into yarn). It is the desire of the rayon industry to provide hollow rayon fibers which will not collapse upon drying and have sufficient crimp for processing through the carding operation and for blending uniformly with other fibers.

Woodings U.S. Pat. No. 3,626,045 is a patent disclosing a method of blowing rayon fibers. It seeks to overcome the problem of fiber wall collapse upon drying by adding to the viscose prior to spinning of from 0.75–2.0 percent by weight of polyethylene glycol based on the weight of the cellulose. The hollow rayon fibers which result can be dried after being formed without collapsing. However, the product of the patent possesses low crimp of about 12 crimps per inch which has been reported to be difficult to card and blend with other fibers.

Patents disclose various methods for making hollow fibers, but none of which applicants are aware teaches or suggests a means which provides a high strength hollow rayon fiber which is substantially irreversible in the sense that it will not collapse upon being dried. These patents include: British Pat. No. 945,306; British Pat. No. 1,393,778; and Freund U.S. Pat. No. 2,013,491.

British Pat. No. 488,500 discloses a process for producing hollow cellulose acetate fibers by extruding a solution of the acetate downward into a volatile solvent medium and in a complicated manner produces a hollow fiber.

Kajitani U.S. Pat. No. 3,418,405 discloses a process for producing flat viscose fibers by extruding blown viscose into a medium containing a modifier, and such modifier is polyethylene glycol. The whole purpose is to produce a hollow fiber which will very readily collapse and form a flat fiber. This is just the opposite of the purpose of the present invention.

British Pat. No. 1,393,778 discloses the preparation of multi-lobal collapsed fibers, which is not what the present invention is concerned with, by a process which is quite different from that of the present invention.

Kobuta et al. Japanese patent publications Nos. 9536 and 9537 are patents describing a process for producing hollow rayon fibers. These processes do not employ sodium carbonate nor sodium bicarbonate nor any other chemical that when in contact with the acidic spin bath will liberate a blowing agent. But rather, this concept employs the evolved $CS_2$ during decomposition in the spin bath as a blowing agent. Because this is a slow blowing process, surfactants are needed so as to reduce the surface tension and allow large bubbles to form. Not only is this process for making hollow fibers quite different, but also it is not one that will produce a high crimp hollow fiber.

Japanese patent publication No. 20164 describes a high crimp solid rayon fiber with high water resistance. The process does not claim a hollow rayon fiber, but rather a solid rayon fiber; furthermore, it teaches away from the process of this invention because it stresses the use of low $CS_2$, i.e., 26–32 percent on the weight of cellulose. It achieves high crimp by using various assistant agents such as monoamines, alkylene oxide polymers and bivalent metallic compounds in combination with the process conditions.

Daul et al. U.S. Pat. Nos. 3,632,468 and 3,793,136 also describe a process for making a high crimp solid rayon fiber. This concept does not involve the production of hollow rayon fibers but only high crimp solid rayon fibers. It seeks to develop high crimp by an alkaline treatment while the fibers are in a relaxed state after they have been stretched and partially regenerated. This concept is quite removed from the process described in our invention. Similarly, Stevens U.S. Pat. No. 3,720,743 also discloses the production of high crimp solid rayon fibers and is remote from the present invention.

In accordance with the present invention, the disadvantages of conventional prior art blown hollow rayon fibers have been overcome by unique conditions of the processes of the present invention. These parameters are discussed below and are employed in the examples which follow.

In copending U.S. application, Serial No. 798,874, filed May 20, 1977, by one of us, namely, Eugene Costa, Jr., now U.S. Pat. No. 4,130,689, granted Dec. 19, 1978, there is disclosed a process for producing superior hollow rayon fibers which do not collapse when dried and washed. However, the hollow rayon fibers of said application do not have the high degree of crimp which characterizes the hollow rayon fibers of the present invention. The fibers possess about 12 crimps per inch.

The hollow fibers of rayon produced by the processes of the invention do not collapse even when dried and will not collapse even when subjected to a sequence of drying and washing treatments. The processes also produce a uniformly large number of blown fibers such as more than 90 or 95 percent of all fibers being hollow or blown.

The fibers produced not only have permanent hollowness, but also exhibit high strength and high crimp to permit ease in carding and uniformity in blending with other fibers. The fibers produced by the processes of the present invention have properties similar to commercial high wet modulus rayon and are approaching that of cotton.

It is, accordingly, an objective of the present invention to provide an in-line process for producing hollow rayon fibers of high strength that have the property of resisting collapse even after drying and washing treatments, which have large continuous lumens, and which possess high crimp, that is, in excess of about 20 crimps per inch with the average being between about 25 and 30 crimps per inch.

It is also an object of the present invention to provide hollow rayon fibers that have high bulk or covering power such as are useful in producing non-wovens or garments for outer wear.

It is a further object of the present invention to provide hollow rayon fibers that have a soft, comfortable hand and which will retain their hollow condition after being immersed in water and then dried.

It is another object of the present invention to provide hollow rayon fibers which have high moisture absorption, thermal insulation and dielectric properties.

It is another object of this invention to produce fibers of high strength having greater than 3.0 g/d (grams per denier) tenacity when tested in a conditioned atmosphere and greater than 1.5 g/d when tested in a wet state.

Other objects will be apparent to those skilled in the art from the present description and the appended drawing which is a photomicrograph of a collection of hollow fibers in accordance with the present invention magnified 1500 times, showing the hollow structure of the fibers.

GENERAL DESCRIPTION OF THE INVENTION

The present invention is directed to novel hollow rayon fibers which retain their hollow condition and can be substantially irreversible in that they resist collapse, even upon repeated dryings and washings, and to a novel inline process for producing them. The fibers also possess a high degree of crimp in excess of about 20 crimps per inch. The resultant hollow rayon fibers are characterized by having a soft, comfortable hand, high moisture absorption properties, large continuous lumens and can be easily carded and used in blends with other man-made or natural fibers. These hollow rayon fibers have high: bulk, strength, moisture absorption, thermal insulation, dielectric properties and covering power, and are useful in producing paper products, non-woven materials, garments for winter wear, outer wear and toweling. The products are characterized by their substantially irreversible nature in that they remain hollow after repeated dryings and washings.

Basically, the process of the present invention results from the discovery that after the fibers or filaments are blown, and before they are dried, their outer walls can be hardened or toughened so that they acquire an outer wall strength that resists collapse of the fiber walls even when repeatedly washed and dried. This toughening can be achieved by one of several means embodied by the present invention. In accordance with one such means, the outer wall hardening can be achieved by employing an aqueous spin bath containing a high zinc sulfate concentration at an optimum, acid and sodium sulfate concentration, into which the viscose containing a high percentage of carbon disulfide ($CS_2$) is spun and in which the fibers are blown by action of the acid on the carbonate blowing agent in the viscose. The conditions of the viscose, ripening index viscosity, NaOH concentration, etc., and that of the spin bath composition are such that regeneration and coagulation is delayed until the blown viscose reaches the stretch zone. This then permits the blown xanthate to undergo a high degree of orientation as crystallization is taking place, thereby creating a blown hollow filament possessing a highly oriented crystalline outer wall structure. This structure has been known to have a high resistance to deformation and thereby cause the fibers to maintain this hollow configuration even after repeated washing and drying cycles.

The high degree of crimp is formed by differential strains created within the cross-sectional area of the fiber. This effect is developed by the combination of the chemical balance of the system, low acid and high zinc concentrations and the mechanical effect created through molecular orientation. The crimp occurs when the fibers are wetted and allowed to free shrink, that is, dried without tension. The difficulty in developing this fiber is in overcoming the paradox that the spin acid concentration needs to be high for blowing the fibers and yet low to develop high crimp. This difficulty is offset by the delicate balance between the amount of $CS_2$ used during xanthation and the high salt concentration in the spin bath.

The concept of the present invention is based on creating a hardened wall that possesses a differential strain within its cross-sectional area, so as to not only prevent wall collapse but also cause crimp to occur when the fibers are allowed to dry in a tensionless state. It is not limited to the methods illustrated in the examples which follow. Any combination of the cases described or any other method of forming ether linkages or any cross-linking processes or other methods of tying up the OH groups on the cellulose comprising the outer portion of the fiber or the fiber wall to prevent hydrogen bonding or any other method of hardening the fiber wall to prevent collapse, such as grafting of other polymers, or by various irradiation techniques are all included in this concept.

The processes of the present invention comprise first the spinning of a viscose solution containing cellulose in an amount of from about 6 percent to 8 percent, optimally 7 percent, of the weight of viscose, alkali metal hydroxide, such as sodium hydroxide, in the amount of from about 6 to 8 percent (preferably about 6.5 to 7.5 percent, optimally 7 percent) of the weight of viscose, and, as a blowing agent, from 3 percent to 5 percent (preferably 3.5 to 4.5 percent, optimally 4 percent) of alkali-metal carbonate, such as sodium or potassium carbonate or sodium or potassium bicarbonate, based on weight of viscose. Said viscose solution shall have a viscosity of from between about 90 poises and 140 poises (preferably 110 to 130 poises, optimally 120), ripening to a salt index from about 6 to 12 milliliters of sodium chloride is desirable, preferably 8 to 10, optimally 9. The viscose solution will desirably contain about 50 to 75 percent by weight of carbon disulfide, preferably about 60 to 70 percent, optimally 65 percent based on weight of cellulose.

The resulting viscose solution is extruded through a spinnerette which comprises capillaries, each having a diameter of from about 25 to 75 microns (preferably 50 microns), into a first coagulating or aqueous acid bath. The time of immersion in the coagulating bath is preferably between about 0.25 and 1.5 seconds, optimally between about 0.5 and 0.7 seconds. This bath comprises from about 150 to 300 grams per liter of sodium sulfate as a coagulating agent, preferably about 240 to 280 (optimally 260) grams per liter of sodium sulfate, and from 20 to 90 grams per liter of zinc sulfate, preferably about 40 to 70 (optimally 50) grams per liter of zinc sulfate, and from about 50 to 80 grams per liter of $H_2SO_4$, preferably about 60 to 70 (optimally 60) grams per liter. The coagulating bath shall have a temperature of at least about 25° C. No advantage is obtained by exceeding a temperature of 100° C. A preferred temperature of the bath is about 25° C. to 65° C., optimally 35° C. to 45° C.

The coagulated fibers from the first coagulating bath or acid bath are then stretched from about 40 to 180 percent, preferably 90 to 100 percent, either in air or optionally within an aqueous stretch bath. A stretch bath, when employed, comprises from about 5 to 30 grams per liter of $H_2SO_4$, (preferably about 10 to 20 grams per liter) and about 2 to 20 grams, preferably 5 to 15 grams, per liter of zinc sulfate. No advantage is obtained by exceeding about 30 grams per liter of zinc sulfate. The preferred concentration of zinc sulfate is about 9 grams per liter. A stretch bath, when employed, is held at a temperature of from about 80° to 100° C., preferably 95° to 100° C. The fibers are then relaxed by approximately 1 percent.

The resulting high crimp, hollow rayon fibers produced by this process can be cut by any conventional method, washed and allowed to dry in a tensionless state or they can be washed, dried in-line on a steam roll, wound as a continuous hollow fiber or filament, then cut, washed and dried in a tensionless state.

The fibers produced by the processes of the invention not only have permanent hollowness, but also exhibit high crimp and high strength. Table 1, below, is a comparative study of the physical properties of this product as compared to regular rayon, high wet modulus rayon, and cotton.

TABLE 1

COMPARISON OF PHYSICAL PROPERTIES OF VARIOUS FIBERS
SINGLE FIBER TEST - INSTRON DATA

| Product | Regular Rayon Staple | High Wet Modulus Rayon | High Strength Hollow Rayon of the Present Invention | Cotton |
|---|---|---|---|---|
| Conditioned Test* | | | | |
| Tenacity, g/d | 2.1 | 3.2 | >3.0 | 3.3 |
| Elongation, % | 10.7 | 9.5 | 8.0 | 9.0 |
| Initial Modulus, % | 60 | 90 | 120 | 50 |
| Wet Test | | | | |
| Tenacity, g/d | 1.0 | 1.6 | 1.7 | 3.9 |
| Elongation, % | 26 | 18 | 14 | 10.0 |
| Modulus at 5% | 3.5 | 7.3 | 8.0 | 10.1 |
| Crimps/inch | 8 | 7 | >20 | 20 |
| Hollowness, % | 0 | 0 | >95 | Collapsed Lumen |

*Conditioned environment - 70° C. to 65% relative humidity (yarn exposed for a minimum of 16 hours).

It is apparent from the above Table 1 that the fibers of the present invention have properties similar to commercial high wet modulus rayon and are approaching that of cotton.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLES

The process conditions used in the experiments of these examples and in producing the hollow fibers tested in Table 1, above, were as follows:

The pulp was kraft hardwood, rayon cellulose equal to 99 percent, having a degree of polymerization of about 520. A steeping of the pulp took place in a steeping solution having a sodium hydroxide concentration of 18 percent, containing the cellulose in a concentration of 32.0 percent of alkali cellulose, and a temperature of 22° C. The viscose obtained from this pulp by the conventional viscose process had a viscosity of 120 poises, with a cellulose content of 7.0 percent based on weight of viscose, 7 percent of sodium hydroxide based on weight of viscose, a variable percentage of carbon disulfide on the weight of cellulose, 4 percent of sodium carbonate based on the weight of viscose.

The viscose was then spun through a spinnerette having 720 holes, each of about 50 μm hole size, at a jet velocity of 25 meters per minute (yielding an extrusion ratio equal to about 0.5), into a first coagulating or aqueous acid bath having the following composition:

- sulfuric acid, concentration, variable as shown in Table 2, below
- sodium sulfate, concentration, variable as shown in Table 2, below
- zinc sulfate, concentration, variable as shown in Table 2, below.

The filaments were immersed for a distance of 10 inches in this bath. The filaments or fibers resulting from the first coagulating bath were then first passed through a second or stretch bath containing 12 grams per liter of sulfuric acid and 9 grams per liter of zinc sulfate at a temperature of 98° C. The fibers were relaxed 1 percent and washed on a wash roll and dried on a steamheated roll (surface temperature 60° C. to 80° C.) and wound on a cap twister as a continuous filament at a rate of 25 meters per minute.

Table 2, below, contains the data derived from a multiple, factorial study. The dependent variables are the number of open fibers expressed as a percentage of the total fibers produced and the crimps per inch. The variables studied in this study are:

| Parameter | Levels |
|---|---|
| Spin bath temperature, °C. | 25, 35, 45 |
| $H_2SO_4$ in spin bath, g/l | 60, 70 |
| $Na_2SO_4$ in spin bath, g/l | 200, 240, 260, 280 |

-continued

| Parameter | Levels |
|---|---|
| $ZnSO_4$ in spin bath, g/l | 30, 50, 70 |
| $CS_2$, % on cellulose | 40, 50, 60, 65, 70 |

TABLE 2

HIGH CRIMP HOLLOW FIBER FACTORIAL STUDY

| $CS_2$, % | $H_2SO_4$ g/l | Zinc Sulfate g/l | Sodium Sulfate g/l | Acid Temp. °C. | Crimps Inch | Open Fibers % |
|---|---|---|---|---|---|---|
| | | | 200 | 25 | 8.8 | 1 |
| | | | | 35 | 14.9 | 1 |
| | | | | 45 | 14.1 | 1 |
| | | 30 | 240 | 25 | 9.4 | 1 |
| | | | | 35 | 15.3 | 1 |
| | | | | 45 | 12.4 | 10 |
| | | | 200 | 25 | 13.2 | 1 |
| | | | | 35 | 16.6 | 1 |
| | | | | 45 | 14.5 | 1 |
| | 60 | 50 | 240 | 25 | 15.2 | 10 |
| | | | | 35 | 16.2 | 90 |
| | | | | 45 | 12.1 | 95 |
| | | | 200 | 25 | 11.2 | 99 |
| | | | | 35 | 10.3 | 99 |
| | | | | 45 | 14.8 | 99 |
| | | 70 | 240 | 25 | 11.1 | 60 |
| | | | | 35 | 11.0 | 95 |
| 40 | | | | 45 | 13.5 | 90 |
| | | | 200 | 25 | 11.5 | 1 |
| | | | | 35Z | 11.7 | 1 |
| | | | | 45 | 10.9 | 1 |
| | | 30 | 240 | 25 | 15.3 | 1 |
| | | | | 35 | 15.5 | 90 |
| | | | | 45 | 15.8 | 95 |
| | | | 200 | 25 | 11.3 | 5 |
| | | | | 35 | 15.9 | 5 |
| | | | | 45 | 19.6 | 15 |
| | 70 | 50 | 240 | 25 | 17.1 | 5 |
| | | | | 35 | 16.7 | 90 |
| | | | | 45 | 15.6 | 95 |
| | | | 200 | 25 | 9.3 | 95 |
| | | | | 35 | 14.1 | 90 |
| | | | | 45 | 10.8 | 90 |
| | | 70 | 240 | 25 | 7.4 | 60 |
| | | | | 35 | 7.9 | 95 |
| | | | | 45 | 8.8 | 90 |
| | | | 200 | 25 | 15.4 | 1 |
| | | | | 35 | 19.1 | 1 |
| | | | | 45 | 17.9 | 1 |
| | | 30 | 240 | 25 | 14.6 | 5 |
| | | | | 35 | 10.1 | 80 |
| | | | | 45 | 11.0 | 50 |
| | | | 200 | 25 | 15.5 | 50 |
| | | | | 35 | 15.9 | 85 |
| | | | | 45 | 20.7 | 80 |
| | 60 | 50 | 240 | 25 | 13.4 | 90 |
| | | | | 35 | 17.5 | 85 |
| | | | | 45 | 19.7 | 70 |
| | | | 200 | 25 | 17.3 | 60 |
| | | | | 35 | 16.7 | 75 |
| | | | | 45 | 15.5 | 80 |
| | | 70 | 240 | 25 | 19.2 | 100 |
| | | | | 35 | 16.1 | 100 |
| 50 | | | | 45 | 18.7 | 100 |
| | | | 200 | 25 | 12.9 | 10 |
| | | | | 35 | 15.1 | 20 |
| | | | | 45 | 19.1 | 10 |
| | | 30 | 240 | 25 | 20.2 | 30 |
| | | | | 35 | 17.3 | 85 |
| | | | | 45 | 19.4 | 90 |

TABLE 2-continued

HIGH CRIMP HOLLOW FIBER FACTORIAL STUDY

| $CS_2$, % | $H_2SO_4$ g/l | Zinc Sulfate g/l | Sodium Sulfate g/l | Acid Temp. °C. | Crimps Inch | Open Fibers % |
|---|---|---|---|---|---|---|
| | | | | 25 | 15.7 | 70 |
| | | | 200 | 35 | 14.7 | 95 |
| | 70 | 50 | | 45 | 17.9 | 50 |
| | | | | 25 | 18.1 | 85 |
| | | | 240 | 35 | 17.8 | 85 |
| | | | | 45 | 21.6 | 80 |
| | | | | 25 | 13.3 | 50 |
| | | | 200 | 35 | 15.1 | 75 |
| | | | | 45 | 17.1 | 60 |
| | | 70 | | | | |
| | | | | 25 | 15.1 | 95 |
| | | | 240 | 35 | 15.8 | 95 |
| | | | | 45 | 14.7 | 80 |
| | | | | 25 | 15.1 | 5 |
| | | | 200 | 35 | 18.9 | 15 |
| | | | | 45 | 22.9 | 5 |
| | | | | 25 | 10.8 | 15 |
| | | | 240 | 35 | 15.0 | 50 |
| | | | | 45 | 18.6 | 75 |
| | | 30 | | | | |
| | | | | 25 | | |
| | | | 260 | 35 | — | — |
| | | | | 45 | | |
| | | | | 25 | 14.3 | 100 |
| | | | 280 | 35 | 23.2 | 100 |
| | | | | 45 | 27.4 | 90 |
| | | | | 25 | 15.9 | 90 |
| | | | 200 | 35 | 15.9 | 85 |
| | | | | 45 | 20.5 | 50 |
| | | | | 25 | 20.1 | 85 |
| | | | 240 | 35 | 17.5 | 50 |
| | | | | 45 | 19.3 | 95 |
| | 60 | 50 | | | | |
| | | | | 25 | | |
| | | | 260 | 35 | — | — |
| | | | | 45 | | |
| | | | | 25 | 15.9 | 40 |
| | | | 280 | 35 | 22.0 | 80 |
| | | | | 45 | 25.3 | 90 |
| 60 | | | | 25 | 15.1 | 75 |
| | | | 200 | 35 | 16.4 | 70 |
| | | | | 45 | 16.4 | 40 |
| | | | | 25 | 13.7 | 95 |
| | | | 240 | 35 | 18.3 | 100 |
| | | | | 45 | 16.7 | 95 |
| | | 70 | | | | |
| | | | | 25 | | |
| | | | 260 | 35 | — | |
| | | | | 45 | | |
| | | | | 25 | | |
| | | | 280 | 35 | — | |
| | | | | 45 | | |
| | | | | 25 | 15.1 | 15 |
| | | | 200 | 35 | 13.3 | 30 |
| | | | | 45 | 13.3 | 5 |
| | | 30 | | | | |
| | | | | 25 | 22.1 | 85 |
| | | | 240 | 35 | 16.7 | 60 |
| | | | | 45 | 17.3 | 70 |
| 60 | | | | 25 | 16.6 | 95 |
| | | | 200 | 35 | 18.9 | 85 |
| | | | | 45 | 16.8 | 10 |
| | 70 | 50 | | | | |
| | | | | 25 | 18.5 | 90 |
| | | | 240 | 35 | 13.1 | 90 |
| | | | | 45 | 14.8 | 95 |
| | | | | 25 | 20.7 | 70 |
| | | | 200 | 35 | 15.7 | 80 |
| | | | | 45 | 17.1 | 80 |
| | | 70 | | | | |
| | | | | 25 | 14.8 | 80 |
| | | | 240 | 35 | 14.0 | 100 |
| | | | | 45 | 14.9 | 100 |
| | | | | 25 | | |
| | | | 240 | 35 | — | — |
| | | | | 45 | | |
| | | | 30 | 25 | 19.1 | 70 |
| | | | 260 | 35 | 21.4 | 50 |

TABLE 2-continued

HIGH CRIMP HOLLOW FIBER FACTORIAL STUDY

| $CS_2$, % | $H_2SO_4$ g/l | Zinc Sulfate g/l | Sodium Sulfate g/l | Acid Temp. °C. | Crimps Inch | Open Fibers % |
|---|---|---|---|---|---|---|
| | | | | 45 | 25.8 | 5 |
| | | | | 25 | | |
| | | | 280 | 35 | — | — |
| | | | | 45 | | |
| | | | | 25 | | |
| | | | 240 | 35 | — | — |
| | | | | 45 | | |
| | | | | 25 | 23.8 | 100 |
| 65 | 60 | 50 | 260 | 35 | 31.8 | 98 |
| | | | | 45 | 28.9 | 95 |
| | | | | 25 | | |
| | | | 280 | 35 | — | — |
| | | | | 45 | | |
| | | | | 25 | | |
| | | | 240 | 35 | — | — |
| | | | | 45 | | |
| 65 | 60 | | | 25 | | |
| | | | 260 | 35 | — | — |
| | | 70 | | 45 | | |
| | | | | 25 | | |
| | | | 280 | 35 | — | — |
| | | | | 45 | | |
| | | | | 25 | 18.9 | 85 |
| | | | 240 | 35 | 20.0 | 50 |
| | | | | 45 | 25.7 | 80 |
| | | | | 25 | | |
| | | 30 | 260 | 35 | — | — |
| | | | | 45 | | |
| | | | | 25 | 14.5 | 70 |
| | | | 280 | 35 | 16.3 | 90 |
| | | | | 45 | 23.7 | 30 |
| | | | | 25 | 17.1 | 85 |
| | | | 240 | 35 | 24.0 | 80 |
| | | | | 45 | 28.7 | 30 |
| | | | | 25 | | |
| 70 | 60 | 50 | 260 | 35 | — | — |
| | | | | 45 | | |
| | | | | 25 | 18.7 | 95 |
| | | | 280 | 35 | 18.1 | 70 |
| | | | | 45 | 20.3 | 85 |
| | | | | 25 | | |
| | | | | 240 | 35 | |
| | | | | 45 | | |
| | | | | 25 | | |
| | | 70 | 260 | 35 | | |
| | | | | 45 | | |
| | | | | 25 | | |
| | | | 280 | 35 | | |
| | | | | 45 | | |

It is apparent from the above Table 2 that fibers possessing both very high crimp, such as 32 crimps per inch and a high degree of hollowness above 95 can be achieved by the correct choice of process conditions within the scope of the processes of the present invention.

Typical physical properties of the high crimp, high strength hollow fibers of the invention are shown below in Table 3:

TABLE 3

| TYPICAL PHYSICAL PROPERTIES | |
|---|---|
| Denier/Filament | 1.5 |
| Conditioned Tenacity, g/d | >3.0 |
| Conditioned Elongation, % | 8.0 |
| Wet Tenacity, g/d | 1.7 |
| Wet Elongation, % | 14.0 |
| Crimps/Inch | >20.0 |
| Degree of Hollowness, % Open | >95 |

The hollow, high crimped fibers shown in the photomicrograph of the appended drawing were prepared in accordance with the process of the invention and foregoing examples in which the viscose contained 65 percent carbon disulfide based on weight of cellulose. The spin bath had a temperature of 35° C. and had the following composition:

| | |
|---|---|
| $H_2SO_4$, g/l | 60 |
| $ZnSO_4$, g/l | 50 |
| $Na_2SO_4$, g/l | 260 |

98 percent of the fibers produced were in the hollow condition and had about 31.8 crimps to the inch.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process for producing high crimp, high strength, hollow rayon fibers resistant to collapse after drying and having at least about 20 crimps to the inch, which process comprises spinning a viscose solution containing alkali cellulose, a blowing agent selected from the class consisting of alkali-metal carbonates and alkali-metal bicarbonates, carbon disulfide, in an amount of between about 50 percent and 75 percent by weight of cellulose, and ripened to a Salt Index of from about 6 to 12 cubic centimeters of sodium chloride, into an aqueous acidic coagulating bath containing from about 150 to 300 grams per liter of sodium sulfate, from about 50 to 80 grams per liter of sulfuric acid, and from about 30 to 90 grams per liter of zinc sulfate, and thereafter stretching the resulting hollow fibers by between about 40 and 180 percent.

2. A process in accordance with claim 1, wherein said viscose solution contains cellulose in an amount of from about 6 to 8.0 percent by weight on weight of viscose, alkali-metal hydroxide in an amount of from about 6 to 8 percent on weight of viscose and a viscosity of from about 90 to 140 poises.

3. A process in accordance with claim 1, wherein said viscose solution contains carbon disulfide in an amount of between about 60 and 70 percent by weight of cellulose, and a viscosity of from about 110 to 130 poises.

4. A process in accordance with claim 1, wherein the aqueous acidic coagulating bath is maintained at a temperature of from about 25° to 65° C.

5. A process in accordance with claim 1, wherein the aqueous acidic coagulating bath is maintained at a temperature of between about 35° and 45° C.

6. A process in accordance with claim 1, wherein the blown filaments, after being formed in the aqueous acid coagulating bath, are passed into an aqueous bath comprising between about 5 and 30 grams per liter of sulfuric acid, between about 2 and 20 grams per liter of zinc sulfate and maintained at a temperature of from about 80° to 100° C.

7. A process in accordance with claim 1, wherein the blowing agent is a member selected from sodium carbonate and sodium bicarbonate.

8. A process in accordance with claim 1, wherein the blowing agent is present in an amount of between about 3.5 percent and 4.5 percent based on weight of cellulose.

9. A process in accordance with claim 1, wherein said viscose solution contains between about 6 and 8.0 percent by weight of cellulose, between about 6 and 8 percent by weight of alkali-metal hydroxide, between about 50 and 75 percent by weight of carbon disulfide, based on weight of cellulose, between about 3 and 5 percent by weight of a member selected from an alkali-metal carbonate and bicarbonate as a blowing agent, said viscose solution having a viscosity of between about 90 and 140 poises and said aqueous acidic coagulating bath contains between about 30 and 80 grams per liter of zinc sulfate, between about 150 and 300 grams per liter of sodium sulfate and between about 50 and 80 grams per liter of sulfuric acid, and stretching the resulting hollow rayon fibers by between about 40 and 180 percent.

10. A process in accordance with claim 1, wherein said viscose solution contains about 7 percent by weight of cellulose, between about 6.5 and 7.5 percent by weight of alkali-metal hydroxide, between about 60 and 70 percent by weight of carbon disulfide, based on weight of cellulose between about 3.5 and 4.5 percent by weight of a member selected from an alkali-metal carbonate and bicarbonate as a blowing agent, said viscose solution having a viscosity of between about 110 and 130 poises and said aqueous acidic coagulating bath contains between about 40 and 70 grams per liter of zinc sulfate, between about 240 and 280 grams per liter of sodium sulfate and between about 60 and 70 grams per liter of sulfuric acid, and stretching the resulting hollow rayon fibers between about 90 and 100 percent.

* * * * *

UNITED STATES PATENT AND TRADEMARK OFFICE

CERTIFICATE OF CORRECTION

PATENT NO. : 4,182,735

DATED : January 8, 1980

INVENTOR(S) : Eugene Costa, Jr. et al.

It is certified that error appears in the above-identified patent and that said Letters Patent are hereby corrected as shown below:

Table 2, columns 8, 9, 10 and 11 should read as follows:

TABLE 2

HIGH CRIMP HOLLOW FIBER FACTORIAL STUDY

| $CS_2$, % | $H_2SO_4$ g/l | Zinc Sulfate g/l | Sodium Sulfate g/l | Acid Temp. °C. | Crimps/ Inch | Open Fibers % |
|---|---|---|---|---|---|---|
| 40 | 60 | 30 | 200 | 25<br>35<br>45 | 8.8<br>14.9<br>14.1 | 1<br>1<br>1 |
| | | | 240 | 25<br>35<br>45 | 9.4<br>15.3<br>12.4 | 1<br>1<br>10 |
| | | 50 | 200 | 25<br>35<br>45 | 13.2<br>16.6<br>14.5 | 1<br>1<br>1 |
| | | | 240 | 25<br>35<br>45 | 15.3<br>16.2<br>12.1 | 10<br>90<br>95 |
| | | 70 | 200 | 25<br>35<br>45 | 11.2<br>10.3<br>14.8 | 99<br>99<br>99 |
| | | | 240 | 25<br>35<br>45 | 11.1<br>11.0<br>13.5 | 60<br>95<br>90 |
| | 70 | 30 | 200 | 25<br>35<br>45 | 11.5<br>11.7<br>10.9 | 1<br>1<br>1 |
| | | | 240 | 25<br>35<br>45 | 15.3<br>13.5<br>15.8 | 1<br>90<br>95 |
| | | 50 | 200 | 25<br>35<br>45 | 11.3<br>15.9<br>19.6 | 5<br>5<br>15 |
| | | | 240 | 25<br>35<br>45 | 17>1<br>16.7<br>15.6 | 5<br>90<br>95 |
| | | 70 | 200 | 25<br>35<br>45 | 9.3<br>14.1<br>10.8 | 95<br>90<br>90 |
| | | | 240 | 25<br>35<br>45 | 7.4<br>7.9<br>8.8 | 60<br>95<br>90 |

UNITED STATES PATENT AND TRADEMARK OFFICE

CERTIFICATE OF CORRECTION

PATENT NO. : 4,182,735

DATED : January 8, 1980

INVENTOR(S) : Eugene Costa, Jr. et al.

It is certified that error appears in the above-identified patent and that said Letters Patent are hereby corrected as shown below:

TABLE 2
(continued)

| $CS_2$, % | $H_2SO_4$ g/l | Zinc Sulfate g/l | Sodium Sulfate g/l | Acid Temp. °C. | Crimps/ Inch | Open Fibers % |
|---|---|---|---|---|---|---|
| 50 | 60 | 30 | 200 | 25<br>35<br>45 | 15.4<br>19.1<br>17.9 | 1<br>1<br>[illegible] |
| | | | 240 | 25<br>35<br>45 | 14.6<br>10.1<br>11.0 | 5<br>80<br>5[illegible] |
| | | 50 | 200 | 25<br>35<br>45 | 15.5<br>15.9<br>20.7 | 50<br>85<br>8[illegible] |
| | | | 240 | 25<br>35<br>45 | 13.4<br>17.5<br>19.7 | 90<br>85<br>7[illegible] |
| | | 70 | 200 | 25<br>35<br>45 | 17.3<br>16.7<br>15.5 | 60<br>75<br>8[illegible] |
| | | | 240 | 25<br>35<br>45 | 19.2<br>16.1<br>18.7 | 100<br>100<br>1[illegible] |
| | 70 | 30 | 200 | 25<br>35<br>45 | 12.9<br>15.1<br>19.1 | 10<br>20<br>1[illegible] |
| | | | 240 | 25<br>35<br>45 | 20.2<br>17.3<br>19.4 | 30<br>85<br>9[illegible] |
| | | 50 | 200 | 25<br>35<br>45 | 15.7<br>14.7<br>17.9 | 70<br>95<br>5[illegible] |
| | | | 240 | 25<br>35<br>45 | 18.1<br>17.8<br>21.6 | 85<br>85<br>8[illegible] |
| | | 70 | 200 | 25<br>35<br>45 | 13.3<br>15.1<br>17.1 | 50<br>75<br>6[illegible] |
| | | | 240 | 25<br>35<br>45 | 15.1<br>15.8<br>14.7 | 95<br>95<br>8[illegible] |

UNITED STATES PATENT AND TRADEMARK OFFICE

CERTIFICATE OF CORRECTION

PATENT NO. : 4,182,735

DATED : January 8, 1980

INVENTOR(S) : Eugene Costa, Jr. et al.

It is certified that error appears in the above-identified patent and that said Letters Patent are hereby corrected as shown below:

TABLE 2
(continued)

| $CS_2$, % | $H_2SO_4$ g/l | Zinc Sulfate g/l | Sodium Sulfate g/l | Acid Temp. °C. | Crimps/ Inch | Open Fibers % |
|---|---|---|---|---|---|---|
| 60 | 60 | 30 | 200 | 25<br>35<br>45 | 15.1<br>18.9<br>22.9 | 5<br>15<br>5 |
| | | | 240 | 25<br>35<br>45 | 10.8<br>15.0<br>18.6 | 15<br>50<br>75 |
| | | | 260 | 25<br>35<br>45 | — | — |
| | | | 280 | 25<br>35<br>45 | 14.3<br>23.2<br>27.4 | 100<br>100<br>90 |
| | | 50 | 200 | 25<br>35<br>45 | 15.9<br>15.9<br>20.5 | 90<br>85<br>50 |
| | | | 240 | 25<br>35<br>45 | 20.1<br>17.5<br>19.3 | 85<br>50<br>95 |
| | | | 260 | 25<br>35<br>45 | — | — |
| | | | 280 | 25<br>35<br>45 | 15.9<br>22.0<br>25.3 | 40<br>80<br>90 |
| | | 70 | 200 | 25<br>35<br>45 | 15.1<br>16.4<br>16.4 | 75<br>70<br>40 |
| | | | 240 | 25<br>35<br>45 | 13.7<br>18.3<br>16.7 | 95<br>100<br>95 |
| | | | 260 | 25<br>35<br>45 | — | — |
| | | | 280 | 25<br>35<br>45 | — | — |

UNITED STATES PATENT AND TRADEMARK OFFICE

CERTIFICATE OF CORRECTION

PATENT NO. : 4,182,735

DATED : January 8, 1980

INVENTOR(S) : Eugene Costa, Jr. et al.

It is certified that error appears in the above-identified patent and that said Letters Patent are hereby corrected as shown below:

TABLE 2
(continued)

| $CS_2$, % | $H_2SO_4$ g/l | Zinc Sulfate g/l | Sodium Sulfate g/l | Acid Temp. °C. | Crimps/ Inch | Open Fibers % |
|---|---|---|---|---|---|---|
| 60 | 70 | 30 | 200 | 25<br>35<br>45 | 15.1<br>13.3<br>13.3 | 15<br>30<br>5 |
| | | | 240 | 25<br>35<br>45 | 22.1<br>16.7<br>17.3 | 85<br>60<br>70 |
| | | 50 | 200 | 25<br>35<br>45 | 16.6<br>18.9<br>16.8 | 95<br>85<br>10 |
| | | | 240 | 25<br>35<br>45 | 18.5<br>13.1<br>14.8 | 90<br>90<br>95 |
| | | 70 | 200 | 25<br>35<br>45 | 20.7<br>15.7<br>17.1 | 70<br>80<br>80 |
| | | | 240 | 25<br>35<br>45 | 14.8<br>14.0<br>14.9 | 80<br>100<br>100 |
| 65 | 60 | 30 | 240 | 25<br>35<br>45 | — | — |
| | | | 260 | 25<br>35<br>45 | 19.1<br>21.4<br>25.8 | 70<br>50<br>5 |
| | | | 280 | 25<br>35<br>45 | — | — |
| | | 50 | 240 | 25<br>35<br>45 | — | — |
| | | | 260 | 25<br>35<br>45 | 23.8<br>31.8<br>28.9 | 100<br>98<br>95 |
| | | | 280 | 25<br>35<br>45 | — | — |

UNITED STATES PATENT AND TRADEMARK OFFICE

CERTIFICATE OF CORRECTION

PATENT NO. : 4,182,735

DATED : January 8, 1980

INVENTOR(S) : Eugene Costa, Jr. et al.

It is certified that error appears in the above–identified patent and that said Letters Patent are hereby corrected as shown below:

TABLE 3
(continued)

| $CS_2$, % | $H_2SO_4$ g/l | Zinc Sulfate g/l | Sodium Sulfate g/l | Acid Temp. °C. | Crimps/ Inch | Open Fibers % |
|---|---|---|---|---|---|---|
| 65 | 60 | 70 | 240 | 25 35 45 | — | — |
| | | | 260 | 25 35 45 | — | — |
| | | | 280 | 25 35 45 | — | — |
| 70 | 60 | 30 | 240 | 25 35 45 | 18.9 20.0 23.7 | 85 50 60 |
| | | | 260 | 25 35 45 | — | — |
| | | | 280 | 25 35 45 | 14.5 16.3 23.7 | 70 90 30 |
| | | 50 | 240 | 25 35 45 | 17.1 24.0 28.7 | 85 80 30 |
| | | | 260 | 25 35 45 | — | — |
| | | | 280 | 25 35 45 | 18.7 18.1 20.3 | 95 70 85 |
| | | 70 | 240 | 25 35 45 | | |
| | | | 260 | 25 35 45 | | |
| | | | 280 | 25 35 45 | | |

Signed and Sealed this

*Twenty-fifth* Day of *March 1980*

[SEAL]

*Attest:*

*Attesting Officer*

SIDNEY A. DIAMOND

*Commissioner of Patents and Trademarks*